US008089449B2

(12) United States Patent
Kohashikawa et al.

(10) Patent No.: US 8,089,449 B2
(45) Date of Patent: Jan. 3, 2012

(54) LIQUID CRYSTAL DISPLAY APPARATUS

(75) Inventors: Seiji Kohashikawa, Suzuka (JP); Yuhya Sekiguchi, Tsu (JP); Yuhichiro Yamaguchi, Yaita (JP)

(73) Assignee: Sharp Kabushiki Kaisha, Osaka (JP)

( * ) Notice: Subject to any disclaimer, the term of this patent is extended or adjusted under 35 U.S.C. 154(b) by 661 days.

(21) Appl. No.: 12/160,240

(22) PCT Filed: Feb. 5, 2007

(86) PCT No.: PCT/JP2007/051898

§ 371 (c)(1),
(2), (4) Date: Jul. 8, 2008

(87) PCT Pub. No.: WO2007/091506

PCT Pub. Date: Aug. 16, 2007

(65) Prior Publication Data

US 2009/0009464 A1 Jan. 8, 2009

(30) Foreign Application Priority Data

Feb. 8, 2006 (JP) ..... 2006-031762
Jan. 30, 2007 (JP) ..... 2007-019511

(51) Int. Cl.
*G09G 3/36* (2006.01)

(52) U.S. Cl. ..... 345/102; 345/1.1; 345/1.2

(58) Field of Classification Search ..... 345/1.1, 345/1.2, 102; 348/687
See application file for complete search history.

(56) References Cited

U.S. PATENT DOCUMENTS 6,795,053 B1 9/2004 Funamoto et al.
2003/0016204 A1 * 1/2003 Lee ..... 345/102
2004/0201561 A1 10/2004 Funamoto et al.
2004/0201562 A1 10/2004 Funamoto et al.
2005/0264702 A1 12/2005 Yoshii
2005/0275641 A1 * 12/2005 Franz ..... 345/204
2006/0132505 A1 * 6/2006 Shin ..... 345/638
2006/0238487 A1 * 10/2006 Shih ..... 345/102

FOREIGN PATENT DOCUMENTS

JP 10-214075 A 8/1998
JP 2002-55664 A 2/2002
JP 2004-258669 A 9/2004
JP 2005-321424 A 11/2005
JP 2005321424 A * 11/2005
JP 2006-145836 A 6/2006
JP 2006-262031 A 9/2006
KR 2001-0099588 11/2001

* cited by examiner

*Primary Examiner* — Amare Mengistu
*Assistant Examiner* — Premal Patel
(74) *Attorney, Agent, or Firm* — Birch, Stewart, Kolasch & Birch, LLP

(57) ABSTRACT

Provided is a liquid crystal display apparatus capable of stopping the brightness control of a back light source on the featuring quantity of an input video signal, in case a multi-plane display was performed. The liquid crystal display apparatus comprises a liquid crystal panel (6) for displaying a picture, a light source for irradiating the liquid crystal panel (6), a backlight unit (7) for controlling the light source, a two-plane control unit (3), and a brightness control unit (4). In accordance with the featuring quantity of the input video signal, the brightness control unit (4) performs the control of the emitting brightness of the back light source, upon the backlight unit (7). In case it is decided by a notice from the two-plane control unit (3) that the display mode for displaying a plurality of planes was selected, the brightness control unit (4) controls the backlight unit (7), so that the emitting brightness of the back light source may be kept constant irrespective of the featuring quantity of the input video signal.

2 Claims, 7 Drawing Sheets

LIQUID CRYSTAL DISPLAY APPARATUS

TECHNICAL FIELD

The present invention relates to a liquid crystal display apparatus, and, more particularly, to a liquid crystal display apparatus that changes emission luminance of a backlight source depending on an input video signal.

BACKGROUND OF THE INVENTION

For a liquid crystal display apparatus including a liquid crystal panel that modulates light-source light in accordance with a video signal and a backlight source for applying light to the liquid crystal panel, technologies have been known that improve quality of displayed video by controlling the emission luminance of the backlight source depending on an input video signal.

For example, in some technologies, an average picture level (hereinafter, APL) of one frame is calculated as a feature quantity of an input video signal to adjust the emission luminance of the backlight source in accordance with the APL, or the emission luminance of the backlight source is adjusted based on the maximum luminance level and the minimum luminance level among luminance levels of pixels in one frame of the input video signal, and in other technologies, the emission luminance of the backlight source is adjusted by analyzing histogram, etc., of the luminance levels of the input video signal.

For example, Patent Document 1 discloses a liquid crystal display apparatus for improving a feeling of visual contrast while evading black floating interference, for reproducing glossy and high-quality videos, and for providing videos of screen luminance optimum to a viewer. The liquid crystal display apparatus of patent document 1 detects APL of the input video signal to control the emission luminance of the backlight source in accordance with the detected APL. A peak value of the input video signal is also detected and the control characteristics are corrected in the emission luminance of the backlight source in accordance with the peak value.

Patent Document 2 discloses an image display device capable of improving a feeling of visual contrast without increasing power consumption of a light source by correlating contrast adjustment (signal amplitude control) with light-source emission luminance adjustment to adjust the light-source luminance such that a visually perceived average luminance level is not changed.

Patent Document 1: Japanese Laid-Open Patent Publication No. 2004-258669

Patent Document 2: Japanese Patent No. 3215400

DISCLOSURE OF THE INVENTION

Problem to be Solved by the Invention

However, when performing the emission luminance control of the backlight source depending on a feature quantity (such as APL) of a video signal in conventional technologies including patent document 1, viewers feel discomfort in some situations. For example, scenes displaying a plurality of screens as exemplary illustrated in FIGS. 7 and 8 may be cited.

For example, when a personal computer (PC) video 51 and a television (TV) video 52 are displayed on left and right sides of a screen divided in two as shown in FIG. 7, if emission luminance control is performed for a backlight source commonly used for the both video displays in accordance with feature quantities of the both video signals, an adverse effect is mutually exerted between the PC video 51 mainly including still images and having screens abruptly changed due to user's operation in some cases and the TV video 52 mainly including moving pictures, and the optimum display luminance cannot be achieved. For example, if a dark video is input to one screen and a bright video is input to the other screen, the emission luminance of the backlight source is controlled in accordance with an intermediate feature quantity and viewers may feel discomfort.

Similarly, in the case of two-screen display with a PC video 61 displayed on the entire screen and a TV video 62 displayed only on a small lower-right area as shown in FIG. 8, if emission luminance control is performed for the backlight source commonly used for the both video displays in accordance with feature quantities of the both video signals, when emission luminance of the backlight source for both is attempted to be controlled an adverse effect is mutually exerted on the video display, and viewers may feel discomfort. In the example of FIG. 8, an adverse effect from the PC video to the TV video becomes greater since a difference between areas of the both screens is larger than the example of FIG. 7.

if the emission luminance control is performed for the commonly used backlight source in accordance with a feature quantity of one video signal rather than controlling the emission luminance of the backlight source in accordance with feature quantities of the both video signals, although the display luminance is suitably controlled on the screen displaying the above one video signal (e.g., the PC video 51, 61), viewers may feel discomfort from the screen displaying the other video signal (e.g., the TV video 52, 62) due to the luminance control corresponding to the feature quantity of the above one video signal.

Since the display quality of the other video signal is adversely affected by controlling the emission luminance of the backlight source in accordance with a feature quantity of one video signal and the adverse effect is mutually exerted even if the emission luminance of the backlight source is controlled in accordance with feature quantities of the both video signals at the time of two-screen display, viewers may feel discomfort in either case. This problem occurs not only in the case of two-screen display but also when three or more screens are displayed at the same time.

The apparatus of patent document 2 reduces effects exerted on the display luminance of the other screen (sub-screen) by the emission luminance control of the backlight source corresponding to the video signal displayed on one screen (main screen) by compensating the video signal displayed on the sub-screen. However, since a liquid crystal panel drive circuit is a digital circuit in general and a word length (number of bits) of digital data is limited although video signals are handled as digital data, an adjustable range of video amplitude has limitations.

For example, it is assumed that the emission luminance of the backlight source is changed from 100% to 50% of the maximum available emission luminance due to the emission luminance control in accordance with a feature quantity of the video signal displayed on one screen. If the video signal level displayed on the other screen is 200 (0% of black corresponds to 16 and 100% of white corresponds to 235 in eight-bit gray-scale expression), the luminance level is restricted to 255 due to the eight-bit constraint although the necessary luminance level is $(200-16)\times2(100\%/50\%)+16=384$. Therefore, the display luminance of the other screen is reduced to about 65% of the necessary luminance and the screen becomes significantly dark. As above, the video-signal amplitude compensation of the apparatus of patent document 2 generates a range where effects cannot be reduced that are exerted on the display luminance of the other screen (sub-screen) by the emission luminance control of the backlight source corresponding to the video signal displayed on one screen (main screen), and viewers may feel discomfort from the range.

The present invention was conceived in view of the above situations and it is therefore the object of the present invention to provide a liquid crystal display apparatus that keeps constant emission luminance control of the backlight source for a feature quantity of an input video signal not to give a feeling of discomfort to viewers when performing multi-screen display to display a plurality of screens.

Means for Solving the Problems

To solve the above problem, a first aspect of the present invention of this application is characterized by a liquid crystal display apparatus comprising a liquid crystal panel that displays a video and a light source that applies light to the liquid crystal panel, the liquid crystal display apparatus variably controlling an emission luminance of the light source in accordance with a feature quantity of an input video signal, the liquid crystal display apparatus keeping the emission luminance of the light source constant regardless of the feature quantity of the input video signal in case a plurality of screens of the same size on the liquid crystal panel respectively displays a plurality of input video signals externally input and having feature quantities of the video signal changing between frames.

A second aspect of the present invention of this application is characterized in that the emission luminance of the light source is kept constant regardless of the feature quantity of the input video signal if a display mode of displaying a plurality of screens on the liquid crystal panel is selected.

A second aspect of the present invention of this application is characterized in that a liquid source that applies light to the liquid crystal panel, the liquid crystal display apparatus variably controlling an emission luminance of the light source in accordance with a feature quantity of an input video signal, the liquid crystal display apparatus suspending a process of variably controlling the emission luminance of the light source in accordance with a feature quantity of the input video signal in case a plurality of screens of the same size on the liquid crystal panel respectively displays a plurality of input video signals externally input and having feature quantities of the video signal changing between frames.

A third aspect of the present invention of this application is characterized by a liquid crystal display apparatus comprising a liquid crystal panel that displays a video and a light source that applies light to the liquid crystal panel, the liquid crystal display apparatus variably controlling the emission luminance of the light source in accordance with a feature quantity of an input video signal, the liquid crystal display apparatus suspending a process of variably controlling the emission luminance of the light source in accordance with a feature quantity of the input video signal if the liquid crystal panel displays a plurality of screens.

A fourth aspect of the present invention of this application is characterized in that a process of variably controlling the emission luminance of the light source in accordance with the feature quantity of the input video signal is suspended if a display mode of displaying a plurality of screens on the liquid crystal panel is selected.

Effect of the Invention

According to the present invention, since emission luminance control of a light source applying light to a liquid crystal panel is suspended regardless of a feature quantity of an input video signal to keep the screen display luminance constant when performing multi-screen display, viewers can be prevented from feeling discomfort due to variations of the display luminance on each screen.

EXPLANATIONS OF REFERENCE NUMERALS

1 . . . liquid crystal display apparatus; 2 . . . video combining portion; 3 . . . two-screen controlling portion; 4 . . . luminance controlling portion; 5 . . . liquid crystal (LCD) controller; 6 . . . liquid crystal displaying portion (liquid crystal panel); 7 . . . backlight unit; 11 . . . APL measuring portion; 12 . . . filter; 13 . . . backlight controlling portion; 14 . . . microcomputer; 15 . . . luminance control table; 16 . . . table storage memory; 30 . . . housing; 31 . . . fluorescent tube; 32 . . . diffusion plate; 41 . . . red light source; 42 . . . green light source; and 43 . . . blue light source.

PREFERRED EMBODIMENTS OF THE INVENTION

Figure 1:
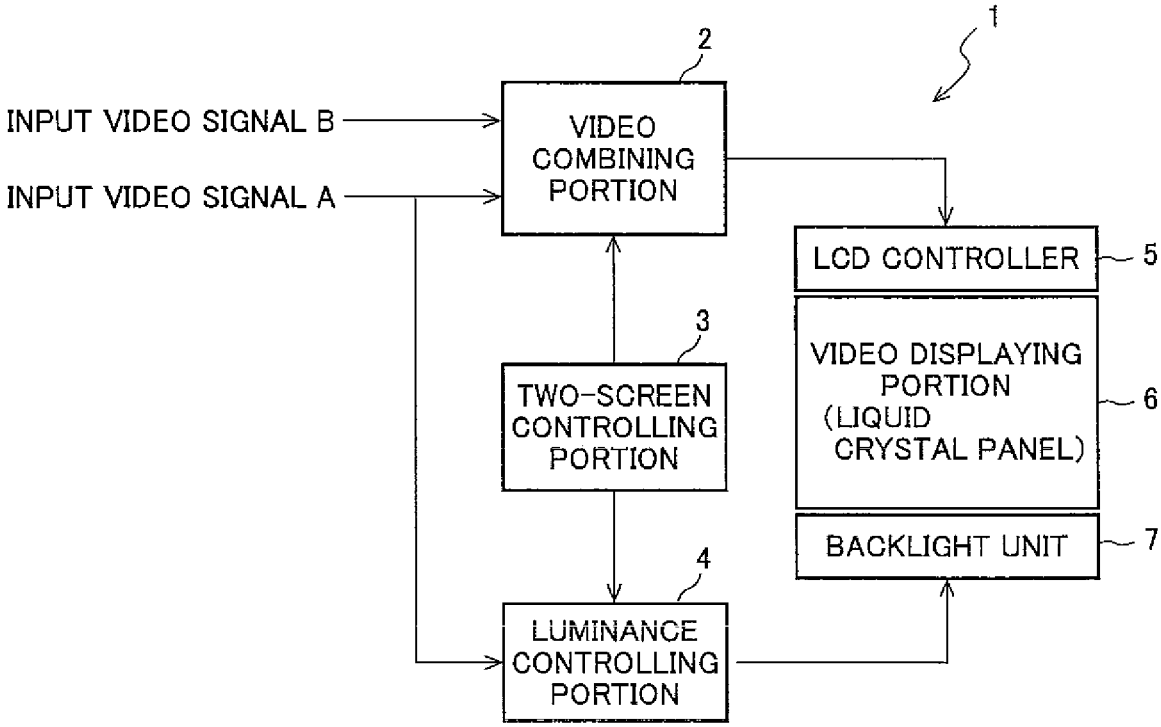
FIG. 1 is an outline block diagram for explaining a configuration of one embodiment of a liquid crystal display apparatus according to the present invention.

FIG. 1 is an outline block diagram for explaining a configuration of one embodiment of a liquid crystal display apparatus according to the present invention and in FIG. 1, a reference numeral 1 denotes a liquid crystal display apparatus. The liquid crystal display apparatus 1 includes a video combining portion 2, a two-screen controlling portion 3, a liquid crystal (LCD) controller 5, a liquid crystal displaying portion (liquid crystal panel) 6, and a backlight unit 7 including a light source. The liquid crystal display apparatus 1 according to the present invention is mainly characterized by including a backlight-source luminance controlling portion 4. Although the following description is basically made based on the premise of two-screen display, the present invention is also applicable to the multi-screen display with three or more screens.

The liquid crystal display apparatus 1 inputs an input video signal A and an input video signal B from a tuner, an input terminal, etc., to send the both input video signals A, B to the video combining portion 2 and to send the input video signal A to the backlight-source luminance controlling portion 4. Although it is assumed that the emission luminance control of the backlight source is performed for the entire screen only in accordance with the feature quantity of the input video signal A in the description of this example, the present invention is also applicable to a configuration that the emission luminance control of the backlight source is performed for the entire screen in accordance with the feature quantities of the both input video signals A, B.

The liquid crystal display apparatus 1 selects/switches whether the one-screen display or the two-screen display is performed in accordance with a display mode indicated by the two-screen controlling portion 3 and outputs information of the display mode to the video combining portion 2 and the backlight-source luminance controlling portion 4. The two-screen controlling portion 3 receives user's operations, etc., to instruct the video combining portion 2 to switch the display modes as needed and sends information of the current display mode (one-screen display mode or two-screen display mode) to the backlight-source luminance controlling portion 4. The two-screen controlling portion 3 controls whether the two-screen display is performed for the input video signals A, B based on user's operations, etc.

The backlight-source luminance controlling portion 4 detects a feature quantity (such as APL) for the entered input video signal A and outputs to the backlight unit 7 an emission luminance control signal for controlling the emission luminance of the backlight source in accordance with the feature quantity.

If it is determined that the display mode is a mode of displaying one screen due to the notification of the display mode from the two-screen controlling portion 3, the backlight-source luminance controlling portion 4 performs the emission luminance control of the backlight source in accordance with the feature quantity of the above video signal. On the other hand, if it is determined that the display mode of displaying two screens is selected due to the notification from the two-screen controlling portion 3, the backlight-source luminance controlling portion 4 controls the backlight unit 7 such that the emission luminance of the backlight source is kept constant regardless of the feature quantity of the input video signal A. By way of example, in the case of the two-screen display mode, the backlight-source luminance controlling portion 4 suspends the emission luminance control of the backlight source in accordance with the feature quantity of the video signal, for example, by not transmitting the emission luminance control signal to the backlight unit 7 or by transmitting the emission luminance control signal giving an instruction to suspend the emission luminance control of the backlight source for the feature quantity of the video signal.

As above, the backlight-source luminance controlling portion 4 of this embodiment executes (turns on)/suspends (turns off) the emission luminance control of the backlight source corresponding to the feature quantity of the above video signal in accordance with the information of the current display mode transmitted from the two-screen controlling portion 3. To perform this control of the backlight-source luminance controlling portion 4, any configuration capable of the multi-screen display is available.

A term "constant" as used herein is intended to include variation of ±1%, which is considered as a range where a viewer cannot recognize a change if luminance is changed in accordance with the Webber's Law. That is, if the emission luminance of the backlight source is 10000 cd/m$^2$ (candela/square meter), variations of the emission luminance of the backlight source is intended to be held within 9900 to 10100 cd/m$^2$.

The video combining portion 2 applies a combining process and various video processes to the input video signals A, B to adjust video in the case of the two-screen display or applies various video processes to the target input video signal to adjust video in the case of the one-screen display and sends the signal to the LCD controller 5. The LCD controller 5 controls the liquid crystal panel 6 based on the combined/adjusted video signal received from the video combining portion 2. The liquid crystal panel 6 is a panel that displays videos based on the control of the LCD controller 5. The emission luminance of the backlight source applying light to the liquid crystal panel 6 is controlled in accordance with the emission luminance control signal transmitted from the backlight-source luminance controlling portion 4.

As above, in this embodiment, when the two-screen display mode is selected, since the emission luminance control of the backlight source in accordance with the feature quantity of the video signal is suspended, the emission luminance control of the backlight source in accordance with the video signal displayed on one screen does not exert an adverse effect on the display luminance of the other screen. As described later, although the emission luminance of the backlight source is kept constant regardless of the feature quantity of the video signal while the emission luminance control of the backlight source in accordance with the feature quantity of the video signal is suspended in this embodiment, the changes in the emission luminance due to a cause other than the feature quantity of the video signal (e.g., control based on a detection result of a brightness sensor and user's operation) is not suspended even while the emission luminance control of the backlight source in accordance with the feature quantity of the video signal is suspended.

Figure 2:
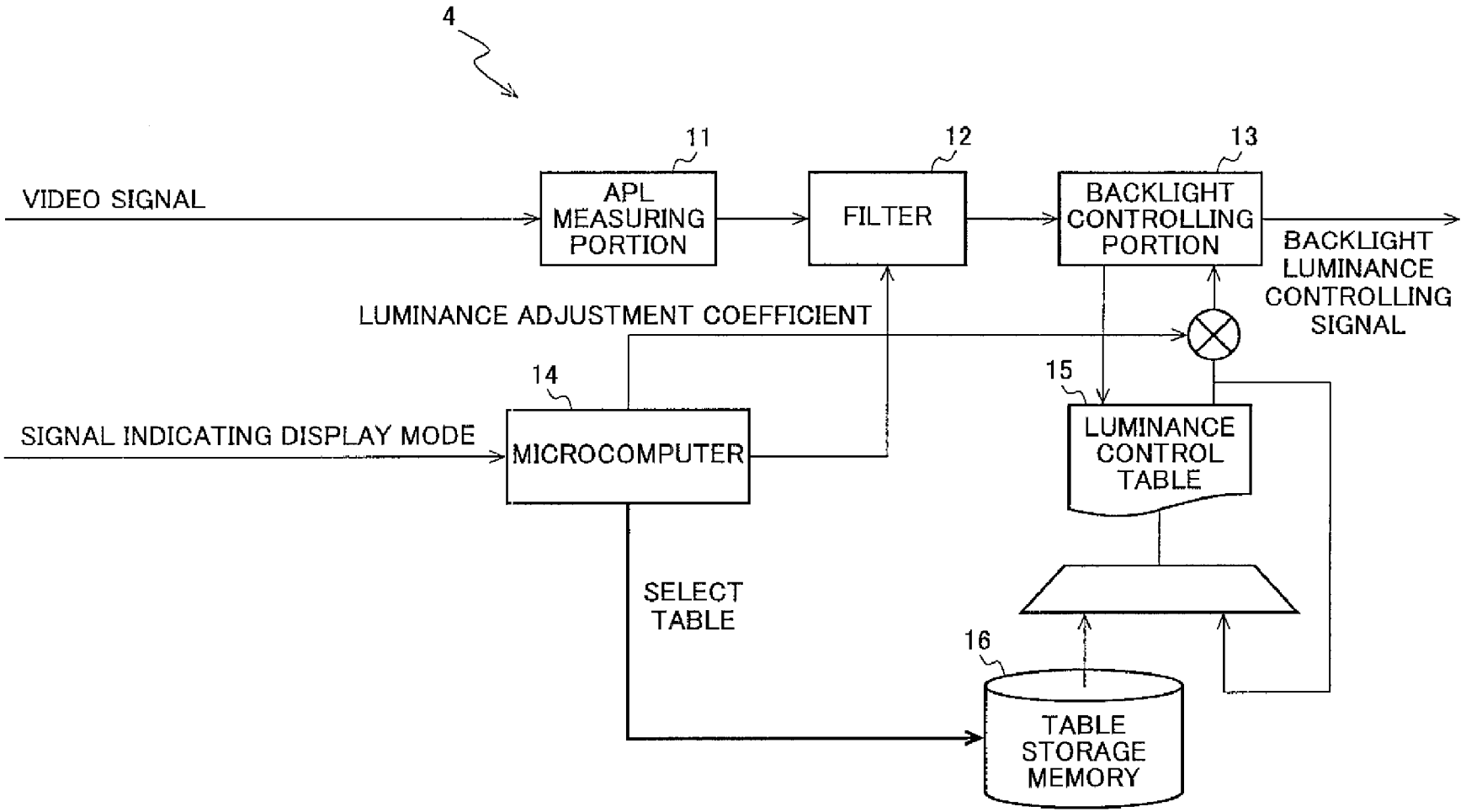
FIG. 2 is a block diagram for explaining an internal configuration of a luminance controlling portion of one embodiment of the liquid crystal display apparatus according to the present invention.

FIG. 2 is a block diagram of the inside of the luminance controlling portion 4 of FIG. 1, and the input video signal is output to an APL measuring portion 11. The APL measuring portion 11 measures APL for each frame of the input video signal. The measured APL is sent to a filter 12. The APL corresponds to one of the feature quantities of the video signal of the present invention and the emission luminance of the backlight source is controlled in accordance with the APL based on emission luminance control characteristics of a luminance control table 15.

Figure 3:
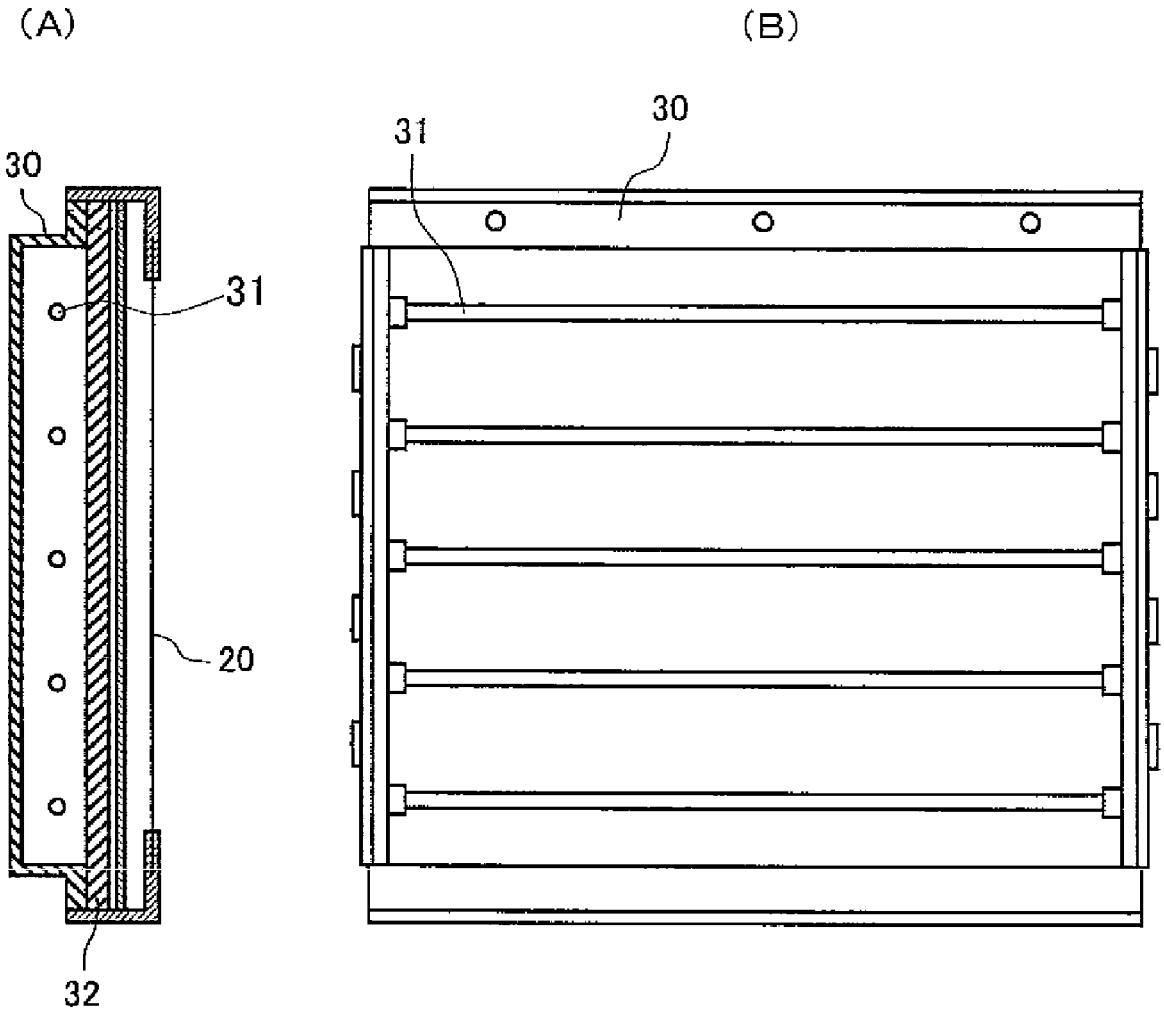
FIG. 3 is a view of an exemplary configuration of a backlight unit applicable to the liquid crystal display apparatus of the present invention.

For example, as shown in FIG. 3, the backlight unit 7 shown in FIG. 1 is configured by disposing a plurality of narrow-tube-shaped fluorescent tubes 31 at even intervals within a housing 30 attached to the backside of the liquid crystal panel 20. A diffusion plate 32 equally diffuses the illumination light emitted from the fluorescent tubes 31.

In this case, for example, the backlight unit 7 includes a light modulation control circuit that outputs a light modulation signal, which is pulse-width modulation output having a signal period ratio (duty) of rectangular-wave high-potential and low-potential levels changed in accordance with the backlight luminance control signal input from a backlight controlling portion 13 of the luminance controlling portion 4, and an inverter that receives the light modulation signal from the light modulation control circuit to generate an alternating voltage having frequency and voltage corresponding to the light modulation signal and that applies the alternating voltage to the fluorescent tubes 31 to drive the fluorescent tubes 31 to emit light (both not shown). The inverter is operated when the output of the above light modulation control circuit is at a high-potential level and is terminated when the output is at a low-potential level, and the emission luminance of the light source is adjusted through this intermittent operation depending on the output duty of the light modulation control circuit.

Figure 4:
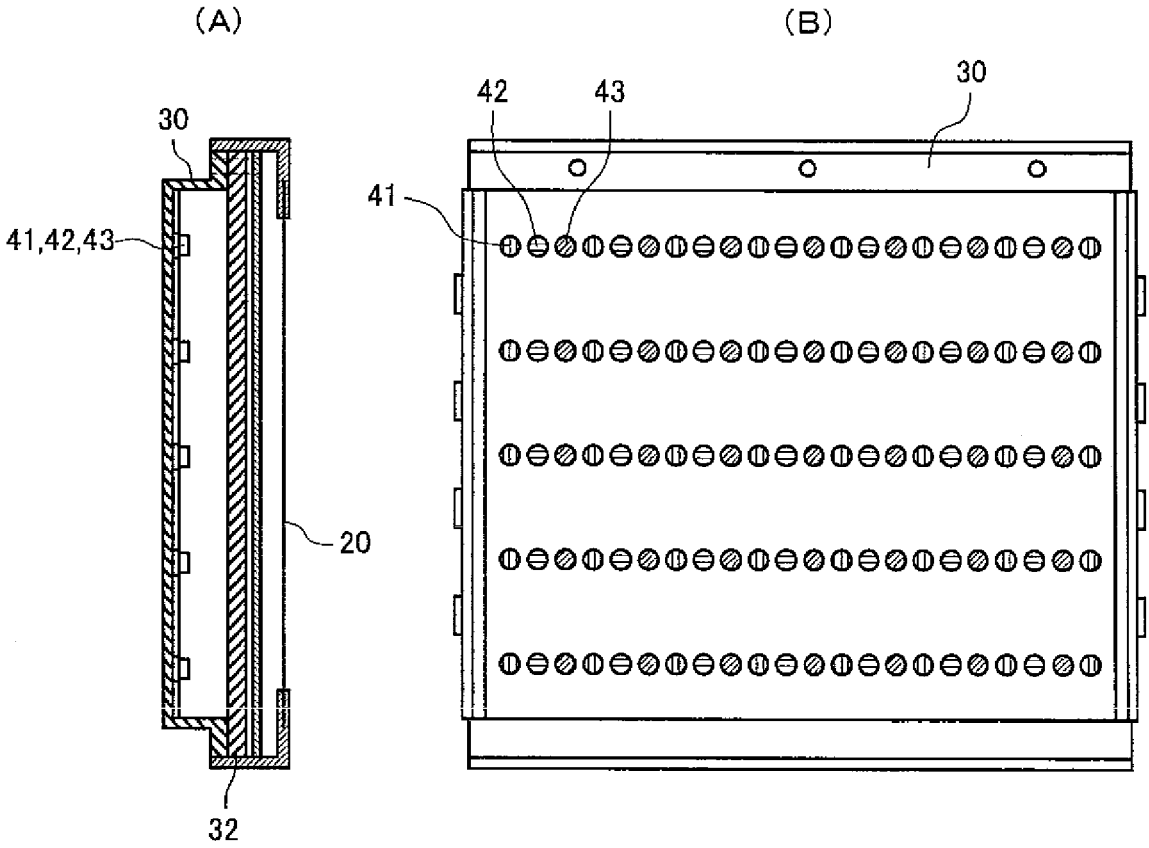
FIG. 4 is a view of another exemplary configuration of the backlight unit applicable to the liquid crystal display apparatus of the present invention.

Alternatively, as shown in FIG. 4, the backlight unit 7 may be configured by disposing LED light sources with a plurality of colors composed of three primary colors of red, green, and blue, i.e., a red light source 41, a green light source 42, and a blue light source 43 within the housing 30 attached to the backside of the liquid crystal panel 20. The emission luminance of the LED light sources may be controlled by LED currents to the respective LED light sources. Although not shown, the above fluorescent tubes and the LEDs may concurrently be used in a mode of those applicable as the backlight unit 7. The light may also be applied to the liquid crystal panel 20 through a so-called side-edge type configuration, which equalizes the light from the light sources such as the fluorescent tubes and the LEDs on a surface with the use of a light guide plate.

When the emission luminance of the backlight source is controlled depending on the measurement value of the APL, the filter 12 of FIG. 2 regulates the follow-up ability for changes in the APL between frames and is made up of a multistage digital filter, for example.

The filter 12 inputs the APL per frame measured by the APL measuring portion 11 and calculates an output APL by performing a weighted average calculation for each frame with the APL of past one or a plurality of frames in accordance with the weightings thereof. The number of past frame stages reflected on the frame can variably be set here and the weightings are set for the current frame and each of the past frames (of the set number of stages). The weighted average is obtained and output for the APL of the current frame and the APL of the delayed frames of the number of used stages in accordance with the weightings thereof. This enables the follow-up ability to be set appropriately for the output APL following the actual changes in the APL.

The APL output from the filter 12 is input to the backlight controlling portion 13. The backlight controlling portion 13 outputs a backlight luminance control signal for adjusting the emission luminance of the backlight source depending on the input APL based on the luminance control table (look-up table) 15 to be used. As described above, the emission luminance of the backlight source is controlled in accordance with the backlight luminance control signal output from the backlight controlling portion 13.

The luminance control table 15 defines a relation of the emission luminance of the backlight source depending on the feature quantity (in this case, APL) of each one frame of the input video signal. In this embodiment, the luminance control table 15 is preliminarily stored in the table storage memory 16 such as a ROM.

At the time of execution of the emission luminance control of the backlight source in accordance with the feature quantity of the input video signal, the luminance control table 15 to be used is read depending on the APL detected from the input video signal to be displayed to control the emission luminance of the backlight source of the backlight unit 7. This reduces the power consumption of the backlight while maintaining the display quality (such as luminance, contrast, and sharpness) of the displayed video.

On the other hand, at the time of suspension of the emission luminance control of the backlight source in accordance with the feature quantity of the input video signal, the emission luminance of the backlight source of the backlight unit 7 is controlled such that the emission luminance is always constant regardless of the APL detected from the input video signal to the displayed. Therefore, in the case of the two-screen mode that gives discomfort to a viewer when executing the emission luminance control of the backlight source for the feature quantity of the input video signal, the emission luminance control of the backlight source depending on the APL of the input video signal can be suspended to maintain the display quality of the displayed video. If the emission luminance control of the backlight source for the APL of the input video signal is suspended, a fixed emission luminance control value stored in a microcomputer 14 or the table storage memory 16 is used, for example.

The signal indicating the display mode is output from the two-screen controlling portion 3 of FIG. 1 and input to the microcomputer 14, and the microcomputer 14 controls the execution/suspension of the emission luminance control of the backlight source corresponding to the feature quantity (in this case, APL) of the video signal based on the signal indicating the display mode input to the microcomputer 14.

If it is determined that the one-screen display mode is indicated, the microcomputer 14 executes the emission luminance control of the backlight source corresponding to the APL of the above video signal. On the other hand, if it is determined that the two-screen display mode is selected, the microcomputer 14 suspends the emission luminance control of the backlight source corresponding to the APL of the above video signal and executes a process such that the emission luminance of the backlight source is kept constant regardless of the APL of the input video signal.

In this embodiment, the changes in the emission luminance due to a cause other than the feature quantity of the video signal (e.g., control based on a detection result of a brightness sensor and user's operation) is not suspended even while the emission luminance control of the backlight source in accordance with the feature quantity of the video signal is suspended.

Figure 5:
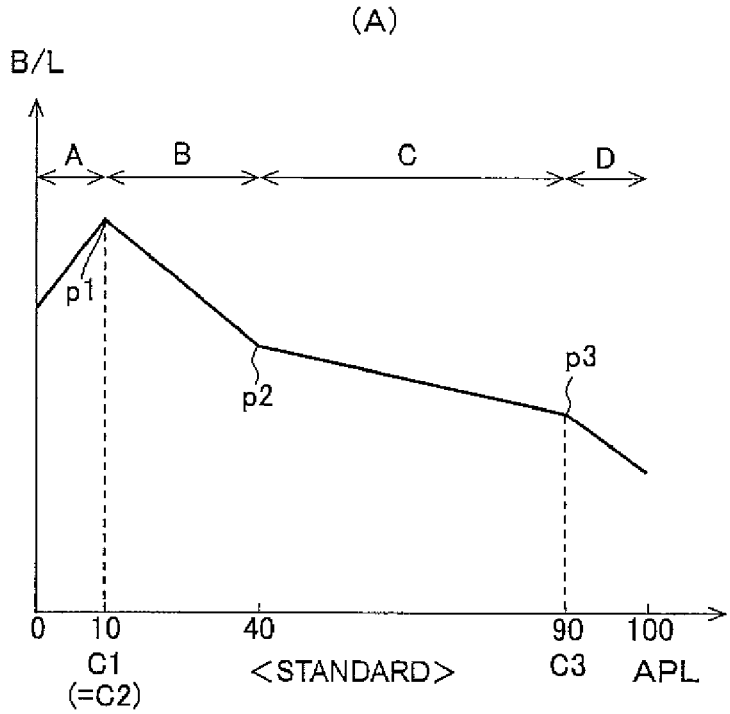
FIG. 5 is a view of an example of emission luminance control characteristics of the backlight source using a luminance conversion table applied at the time of execution of the emission luminance control of the backlight source.
Figure 5:
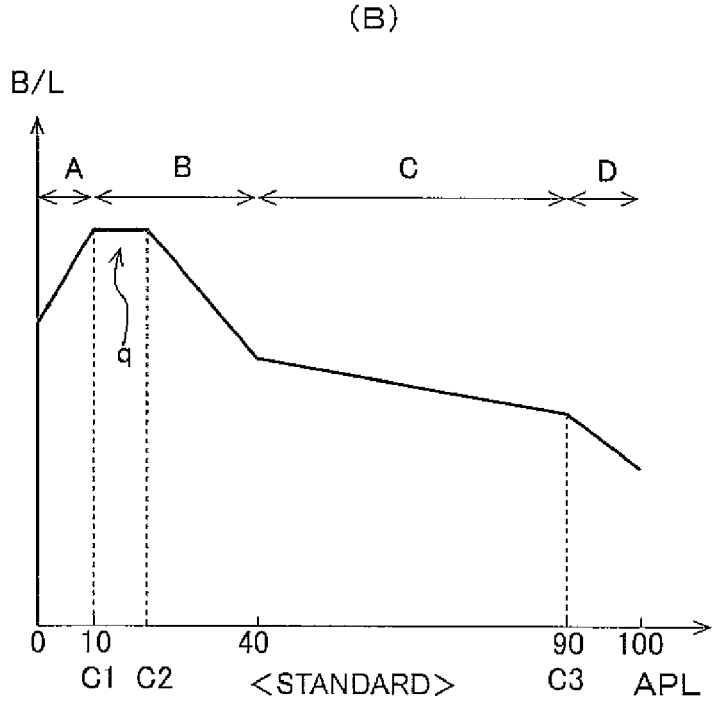

FIG. 5 is a view of an example of emission luminance control characteristics of the backlight source using a luminance control table applied at the time of execution of the emission luminance control of the backlight source depending on the feature quantity (in this case, APL) of the video signal. In FIG. 5, the horizontal axis indicates the APL in percentage, and if the entire screen of the displayed video is black, the APL is 0%, and if the screen is entirely white, the APL is 100%. The vertical axis indicates an emission luminance ratio of the backlight source, which is 100% when the emission luminance of the backlight source is maximized and 0% when the backlight source is turned off.

The emission luminance control characteristics shown in FIGS. 5(A) and 5(B) represent that the emission luminance control characteristics of the backlight source for the APL are changed in accordance with a signal area with low APL indicated by A, signal areas with intermediate-level APL indicated by B and C, and a signal area with high APL indicated by D. It is defined here that a characteristic change point is a change point of the slope of the emission luminance control of the backlight source for the feature quantity (in this example, APL) of the video signal. In FIG. 5(A), the characteristic change points are intersection points p1, p2, and p3 of lines of the four areas A to D.

In this embodiment, the characteristic change point p1 located closer to the lowest APL of the emission luminance control characteristics is set to the position of 10% APL, and the characteristic change point p3 located closer to the highest APL is set to the position of 90% APL. The characteristic change point p2 is set to the position of 40% APL. The characteristic change point p1 with the 10% APL is defined as the characteristic change point having the maximum emission luminance of the backlight source.

As above, the embodiment according to the present invention is characterized in that the emission luminance of the backlight source is held down in either or both the signal areas with the extremely low and extremely high video-signal feature quantities (APL) to reduce power consumption while maintaining the image quality. As long as such characteristics are satisfied, the emission luminance control characteristics are not limited to the above example. For example, as shown in FIG. 5(B), a signal area q having a constant emission luminance value of the backlight source may exist in a signal area with the APL greater than the characteristic change point p1 closer to the lowest APL.

The emission luminance control characteristics may be not only the linear characteristics as above but also nonlinear characteristics. If the emission luminance control characteristics are nonlinear, the nonlinear emission luminance control characteristics can be approximated by linear luminance control characteristics, and the emission luminance control of the backlight source can be regulated as is the case with the above linear luminance control characteristics by assuming the characteristic change point in the approximate linear emission luminance control characteristics. The light source emission luminance may be controlled with the use of characteristics reducing the emission luminance of the backlight source as the APL becomes lower and the amplitude of the video signal may be increased to improve the contrast while constraining the black floating.

Figure 6:
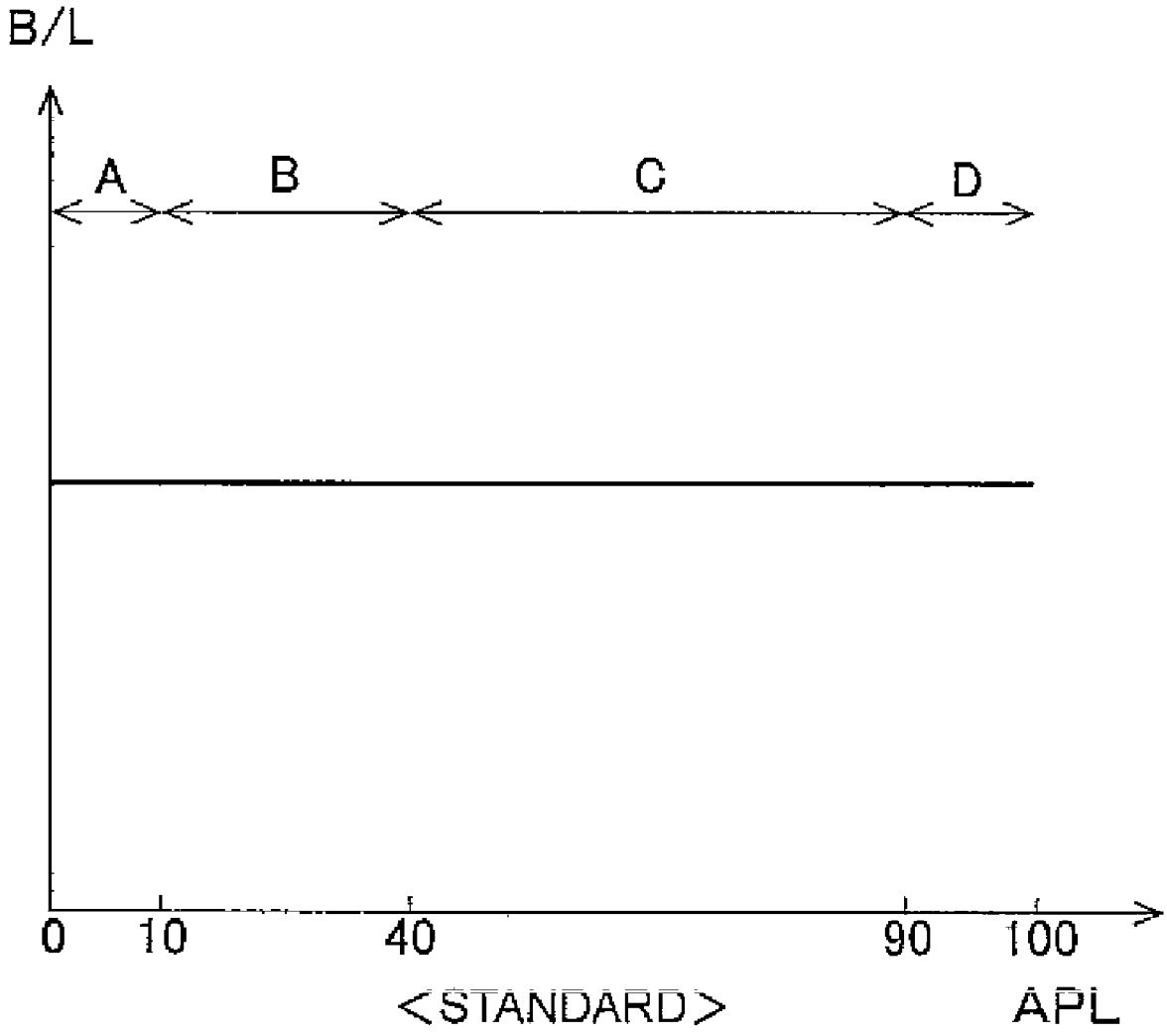
FIG. 6 is a view of an example of emission luminance control characteristics of the backlight source using a fixed value applied at the time of suspension of the emission luminance control of the backlight source.
Figure 7:
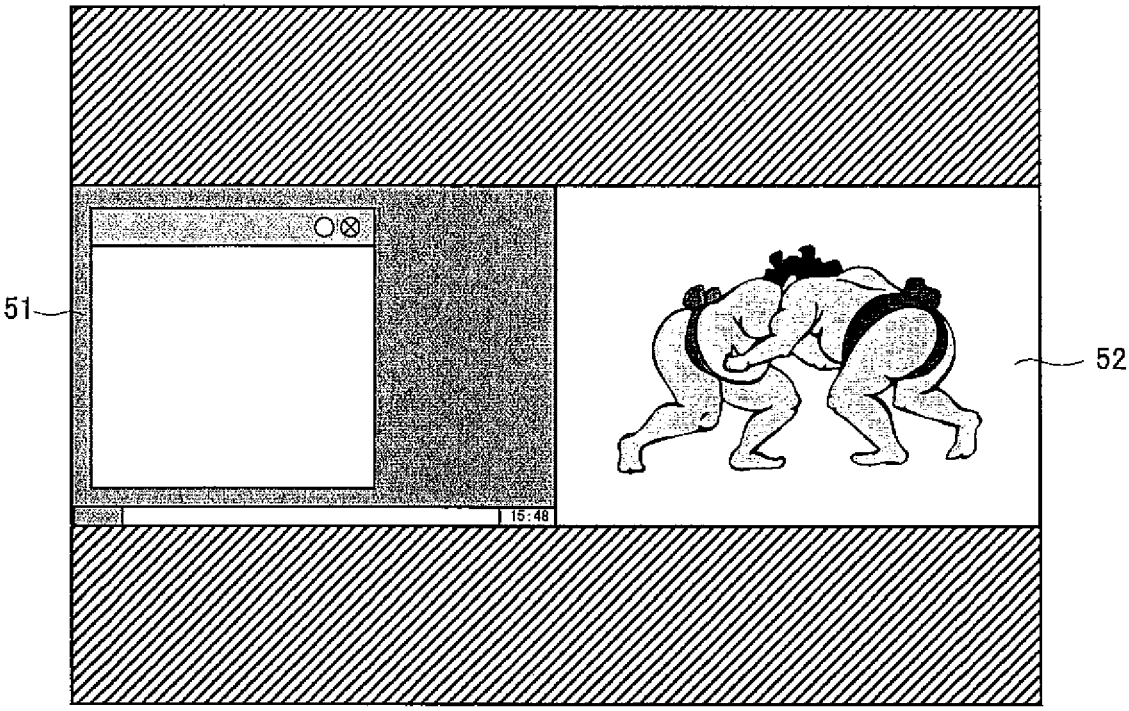
FIG. 7 is a view for explaining an example of situations when a viewer feels discomfort due to the emission luminance control of the backlight source in accordance with APL of video signals in conventional technologies.
Figure 8:
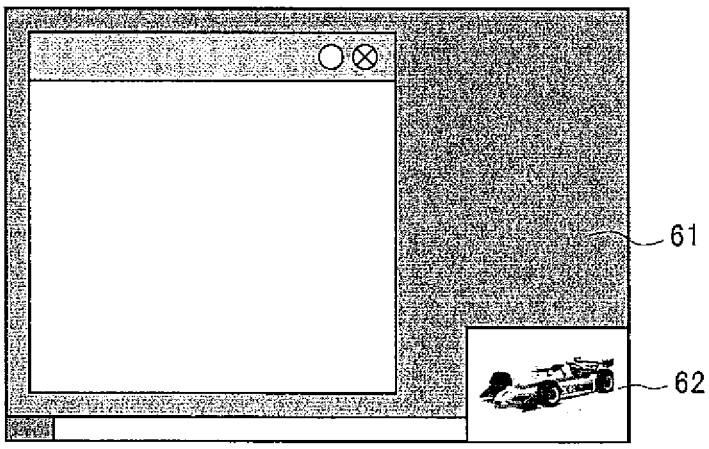
FIG. 8 is a view for explaining another example of situations when a viewer feels discomfort due to the emission luminance control of the backlight source in accordance with APL of video signals in conventional technologies.

FIG. 6 is a view of an example of emission luminance control of the backlight source characteristics using a fixed value applied at the time of suspension of the emission luminance control of the backlight source corresponding to the feature quantity (in this case, APL) of the video signal. The graph of FIG. 6 is plotted in the same way as FIG. 5. At the time of suspension of the emission luminance of the backlight source control corresponding to the APL of the video signal, a fixed value is used for the emission luminance control and, therefore, the emission luminance control characteristics entirely have the same level for the areas A to D of FIG. 5. The emission luminance control of the backlight source for the APL of the video signal is suspended by keeping the same level regardless of the values of the APL.

Although the present invention has been exemplarily illustrated with reference to the drawings as for one embodiment and the APL is used as a feature quantity of the input video signal to control the emission luminance of the backlight source depending on the APL in the above examples, the above feature quantity is not limited to the APL and for example, a state of peak luminance (presence or degree) in one frame of the input video signal may be utilized.

Alternatively, the maximum and minimum luminance levels and the luminance distribution status (histogram) in a predetermined area (period) of one frame may be used for the feature quantity of the input video signal, or the emission luminance of the backlight source may variably be controlled based on a video-signal feature quantity of the video signal obtained from a combination thereof.

To perform the emission luminance control of the backlight source for the feature quantity of the video signal with the use of the APL, an average value does not have to be obtained from the luminance levels of all the video signals of one frame to obtain the APL and, for example, an average value may be obtained from the luminance levels of video signals near the center exclusive of the edge portions of the displayed video to use this value as the APL of the video signals. For example, based on genre information separated/acquired from broadcast reception signals, the gate control may be performed such that a preset screen area (likely to be overlapped with characters/symbols, etc.) is excluded to measure the APL only in a predetermined part of an area.

The above emission luminance conversion control is applicable not only to a direct-view liquid crystal displaying device including the backlight unit as shown in FIG. 3 or 4 but also to a projection type displaying device such as a liquid crystal projector. In this case, the video display is performed by applying the light-source light from the backside of the liquid crystal panel and the emission luminance of the light-source light may be controlled in accordance with the above emission luminance control characteristics.

The invention claimed is:

1. A liquid crystal display apparatus comprising:

a liquid crystal panel that displays a video; and a light source that applies light to the liquid crystal panel, the liquid crystal display apparatus variably controlling an emission luminance of the light source in accordance with a feature quantity of an input video signal, wherein the liquid crystal display apparatus keeps the emission luminance of the light source constant regardless of the feature quantity of the input video signal in the case when a plurality of screens of the same size on the liquid crystal panel each respectively display one of a plurality of externally input video signals and the feature quantities of the video signals change between frames.

2. A liquid crystal display apparatus comprising:

a liquid crystal panel that displays a video; and a light source that applies light to the liquid crystal panel, the liquid crystal display apparatus variably controlling an emission luminance of the light source in accordance with a feature quantity of an input video signal, wherein the liquid crystal display apparatus suspends a process of variably controlling the emission luminance of the light source in accordance with a feature quantity of the input video signal in the case when a plurality of screens of the same size on the liquid crystal panel each respectively display one of a plurality of externally input video signals and the feature quantities of the video signals change between frames.

* * * * *